US010436452B2

(12) United States Patent
Martinez Diez et al.

(10) Patent No.: US 10,436,452 B2
(45) Date of Patent: Oct. 8, 2019

(54) GAS BURNER ARRANGEMENT, COOKTOP AND STOVE

(71) Applicant: BSH Hausgeräte GmbH, Munich (DE)

(72) Inventors: Alvaro Martinez Diez, Peñacastillo (ES); Luis Antonio Palacios Valdueza, Astillero (ES); Carlos Pelayo Alonso, Villafufre (ES); Emilio Placer Maruri, Liencres (ES); Roberto Saiz Gonzalez, Villapresente-Cantabria (ES)

(73) Assignee: BSH Hausgeräte GmbH, Munich (DE)

( * ) Notice: Subject to any disclaimer, the term of this patent is extended or adjusted under 35 U.S.C. 154(b) by 407 days.

(21) Appl. No.: 15/319,811

(22) PCT Filed: Jun. 30, 2015

(86) PCT No.: PCT/IB2015/054906
§ 371 (c)(1),
(2) Date: Dec. 19, 2016

(87) PCT Pub. No.: WO2016/001837
PCT Pub. Date: Jan. 7, 2016

(65) Prior Publication Data

US 2017/0138606 A1 May 18, 2017

(30) Foreign Application Priority Data

Jul. 4, 2014 (ES) ..... 201431004

(51) Int. Cl.
*F24C 3/00* (2006.01)
*F24C 3/08* (2006.01)
(Continued)

(52) U.S. Cl.
CPC ..... *F24C 3/082* (2013.01); *F23N 5/105* (2013.01); *F24C 3/022* (2013.01); *F24C 3/122* (2013.01);
(Continued)

(58) Field of Classification Search
USPC ..... 126/39 R, 39 E, 39 H, 39 N; 200/16 R, 200/16 A, 16 B, 16 E; 431/42, 50–56, 80
See application file for complete search history.

(56) References Cited

U.S. PATENT DOCUMENTS 964,798 A * 7/1910 Lewis ..... H01H 21/42 200/16 B
2,498,651 A 2/1950 Crom
(Continued)

FOREIGN PATENT DOCUMENTS

DE 8617444 A1 11/1987
DE 102006022326 A1 11/2007
(Continued)

OTHER PUBLICATIONS

International Search Report PCT/IB2015/054906 dated Oct. 19, 2015.
National Search Report CN 201580035578.3 dated Apr. 10, 2018.

*Primary Examiner* — Vivek K Shirsat
(74) *Attorney, Agent, or Firm* — Michael E. Tschupp; Andre Pallapies; Brandon G. Braun

(57) ABSTRACT

A gas burner arrangement for a hotplate includes at least two gas burners, each gas burner having operably connected thereto a gas valve for regulating a combustion gas flow to the gas burners, and a thermoelement for monitoring a flame of the gas burners. The thermoelement is coupled to the gas valve by an electrical circuit, such that when the flame of the associated gas burner is extinguished, the combustion gas flow to the gas burner is interrupted with the aid of the gas valve. Each electrical circuit includes a mechanically actuatable switch configured to couple or decouple the electrical circuit between the associated thermoelement and the associated gas valve. The mechanically actuatable switch includes a contact element having a noble metal. A shared
(Continued)

actuation element controls the mechanically actuatable switches of the electric circuits.

12 Claims, 7 Drawing Sheets

(51) Int. Cl.

| | |
|---|---|
| ***F24C 3/12*** | (2006.01) |
| ***F23N 5/10*** | (2006.01) |
| ***F24C 3/02*** | (2006.01) |
| *H01H 1/023* | (2006.01) |
| *H01H 19/635* | (2006.01) |

(52) U.S. Cl.
CPC ..... *F24C 3/126* (2013.01); *H01H 1/023* (2013.01); *H01H 19/635* (2013.01)

(56) References Cited

U.S. PATENT DOCUMENTS

| | | | | |
|---|---|---|---|---|
| 2,849,891 | A | 9/1958 | Mills | |
| 2,972,262 | A | 2/1961 | Kunzler | |
| 5,744,766 | A * | 4/1998 | Sambar ..... | H01H 1/20 200/16 A |
| 2008/0250785 | A1 | 10/2008 | Carlson et al. | |
| 2015/0153048 | A1 | 6/2015 | Moro et al. | |

FOREIGN PATENT DOCUMENTS

| | | | |
|---|---|---|---|
| EP | 1251316 | A2 | 10/2002 |
| WO | 2008130537 | A2 | 10/2008 |

* cited by examiner

GAS BURNER ARRANGEMENT, COOKTOP AND STOVE

CROSS-REFERENCES TO RELATED APPLICATIONS

This application is the U.S. National Stage of International Application No. PCT/IB2015/054906, filed Jun. 30, 2015, which designated the United States and has been published as International Publication No. WO 2016/001837 and which claims the priority of Spanish Patent Application, Serial No. P201431004, filed Jul. 4, 2014, pursuant to 35 U.S.C. 119(a)-(d).

BACKGROUND OF THE INVENTION

The present invention relates to a gas burner arrangement, a hotplate and a cooker.

A hotplate may have a gas burner arrangement with a gas valve, a gas burner and a feed line connecting the gas valve with the gas burner. Furthermore, the gas burner arrangement may comprise a thermoelement for monitoring a flame of the gas burner. Once the thermoelement is applied with heat by means of the flame of the gas burner, this supplies electrical voltage to a solenoid valve of the gas valve. When the flame is extinguished, the thermoelement cools down and no longer applies electrical voltage to the solenoid valve. The solenoid valve closes the gas valve in order to interrupt the combustion gas flow from the gas valve to the gas burner. In this way an unwanted escape of unburned combustion gas is prevented.

EP 1 251 316 B1 describes a gas burner arrangement with a number of gas burners and a number of gas valves, wherein a mechanically actuatable switch is provided in an electrical connection between a respective thermoelement of a gas burner and the gas valve. The mechanically actuatable switches of all gas burners are mechanically coupled to one another using a connector. All switches are opened simultaneously by actuating the connector.

BRIEF SUMMARY OF THE INVENTION

Against this background an object of the present invention consists in making available an improved gas burner arrangement.

Accordingly, a gas burner arrangement for a hotplate with at least two gas burners is proposed, to which a gas valve for regulating a combustion gas flow to the gas burner and a thermoelement for monitoring a flame of the gas burner is assigned in each case, wherein each thermoelement is coupled to the gas valve assigned thereto with the aid of an electrical circuit such that when the flame of the gas burner is extinguished, the combustion gas flow to the gas burner is interrupted with the aid of the gas valve, wherein each electrical circuit has a mechanically actuatable switch, wherein the mechanically actuatable switches for coupling or decoupling the electrical circuits between the thermoelements and the gas valves can be actuated with the aid of a shared actuation element and wherein the mechanically actuatable switches comprise contact elements which have a noble metal.

For instance, an electrical connection between the gas valve and the respective thermoelement is interrupted with the aid of the switch.

A particularly good conductivity of the contact elements can be achieved due to the contact elements having a noble metal. The contact elements can be coated with the noble metal or manufactured entirely from the noble metal. Furthermore, the contact elements are particularly wear-resistant. The mechanically actuatable switches can be arranged one behind another, next to one another and for instance in pairs, one behind the other. This produces a particularly compact design. Assembly costs can then be reduced as a result. Furthermore, the operational reliability of the gas burner arrangement is increased. An axial movement of the actuation element results in the simultaneous separation of all thermoelements from the gas valves.

According to one embodiment the contact elements have gold.

Alternatively, the contact elements may have silver, platinum, rhodium or suchlike.

According to a further embodiment, the gas burner arrangement has a switching device which has the mechanically actuatable switches and the actuation element.

The actuation element is in particular rod-shaped and has a circular cross-section. An actuation knob can be provided on the actuation element, said actuation knob engaging in a form-fit manner into a flat area provided on the actuation element. The switching device preferably has sockets or inputs for the thermoelements and further sockets or outputs for connection to the gas valves. The number of inputs preferably corresponds to the number of outputs.

According to a further embodiment, the actuation element is pretensioned in the direction of a closed position of the mechanically actuatable switch with the aid of a spring device.

The switches are closed in an output or default position. The spring device is in particular a compression spring. The spring device may be a cylindrical spring.

According to a further embodiment, the mechanically actuatable switches can be brought from the closed position into an open position by displacing the actuation element against a spring force of the spring device.

According to a further embodiment, the actuation element has a sliding block guide into which a guiding pin provided on a housing of the switching device engages.

The guiding pin is preferably spring-pretensioned and presses against a groove of the sliding block guide. The guiding pin is supported in a sliding manner in the groove.

According to a further embodiment, the sliding block guide has a locking section, into which the guiding pin engages in the open position.

The locking section is embodied as a depression or recess in the groove. Since the guiding pin is spring-pretensioned, it automatically engages in the locking section.

According to a further embodiment, the guiding pin can be automatically displaced from the open position into the closed position by displacing the actuation element in the direction of the open position and by simultaneously rotating the same with the aid of the spring device.

By displacing the actuation element in the direction of the open position, the guiding pin is preferably lifted out of the locking section of the groove. The simultaneous rotation of the actuation element prevents a re-engagement of the guiding pin in the locking section. As the actuation element has to be pressed down and simultaneously rotated in order to bring it into the closed position, an unwanted closure of the switches can be prevented. This increases safety during the operation of the gas burner arrangement.

The gas burner arrangement is equipped in particular with a master switch, which comprises the mechanical switches, the actuation element and the contact elements. Here provision can be made for a first number of plug-in connectors for coupling the thermoelements with the aid of cables or the like to the master switch. Furthermore, provision can be made for a second number of plug-in connectors for coupling electromechanical solenoid valves with the aid of cables or the like to the master switch. The first number preferably corresponds to the second number to provide a one-to-one coupling and decoupling of a respective thermoelement to or from a respectively assigned solenoid valve for instance. This results in improved reliability and thus safety of the gas burner arrangement.

Moreover, a hotplate with a gas burner arrangement of this type is proposed.

The hotplate is preferably part of a domestic appliance.

Furthermore, a cooker with a gas burner arrangement of this type and/or a hotplate of this type is proposed.

The cooker is in particular a domestic appliance.

Further possible implementations of the gas burner arrangement, the hotplate and/or the cooker also comprise combinations—not explicitly cited—of features or forms of embodiment described above or below in respect of the exemplary embodiments. Here the person skilled in the art will also add individual aspects as improvements or amendments to the respective basic form of the gas burner arrangement, the hotplate and/or the cooker.

BRIEF DESCRIPTION OF THE DRAWINGS

Further advantageous embodiments and aspects of the gas burner arrangement, the hotplate and/or the cooker form the subject matter of the subclaims and the exemplary embodiments of the gas burner arrangement, the hotplate and/or the cooker described below. The gas burner arrangement, the hotplate and/or the cooker are further explained in greater detail on the basis of the preferred embodiments with reference to the appended figures.

DETAILED DESCRIPTION OF EXEMPLARY EMBODIMENTS OF THE PRESENT INVENTION

Figure 1:
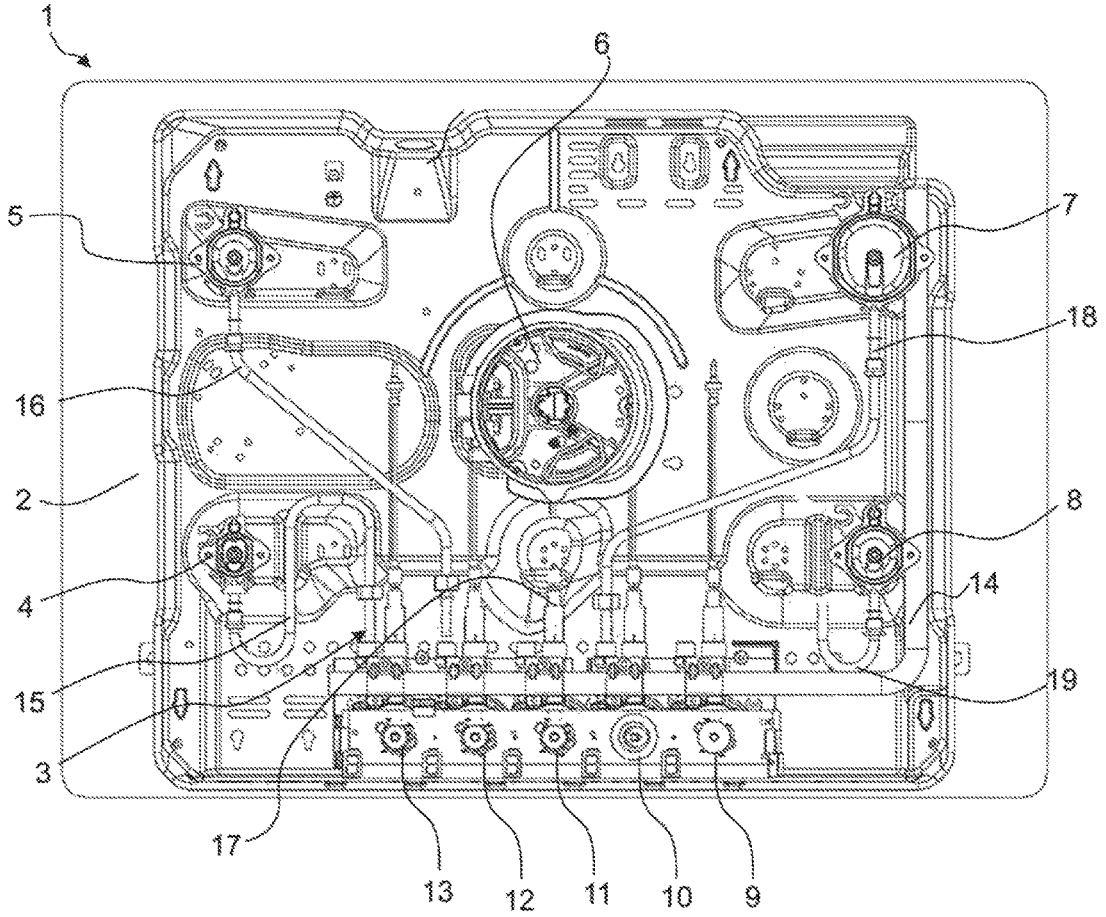
FIG. 1 shows a schematic view of an embodiment of a hotplate.

Elements which are the same or function the same have been provided with the same reference characters in the figures, unless specified otherwise.

FIG. 1 shows a schematic view of a cooker 1. The cooker 1 is in particular a gas cooker. The cooker 1 is a domestic appliance. The cooker 1 has a hotplate 2 with a gas burner arrangement 3. The gas burner arrangement 3 has at least two gas burners 4 to 8. The number of gas burners 4 to 8 is arbitrary. As FIG. 1 shows, the gas burner arrangement 3 may have five gas burners 4 to 8. Alternatively, the gas burner arrangement 3 may have three or four gas burners 4 to 8 for instance. A gas valve 9 to 13 is assigned to each gas burner 4 to 8. The gas valves 9 to 13 are preferably gas control valves. The gas valves 9 to 13 are configured to regulate or optionally interrupt in steps or steplessly a combustion gas flow or gas volume flow to the respective gas burner 4 to 8. Each gas valve 9 to 13 is fastened to a main gas line 14. The gas valves 9 to 13 are preferably fastened to the main gas line 14.

Figure 2:
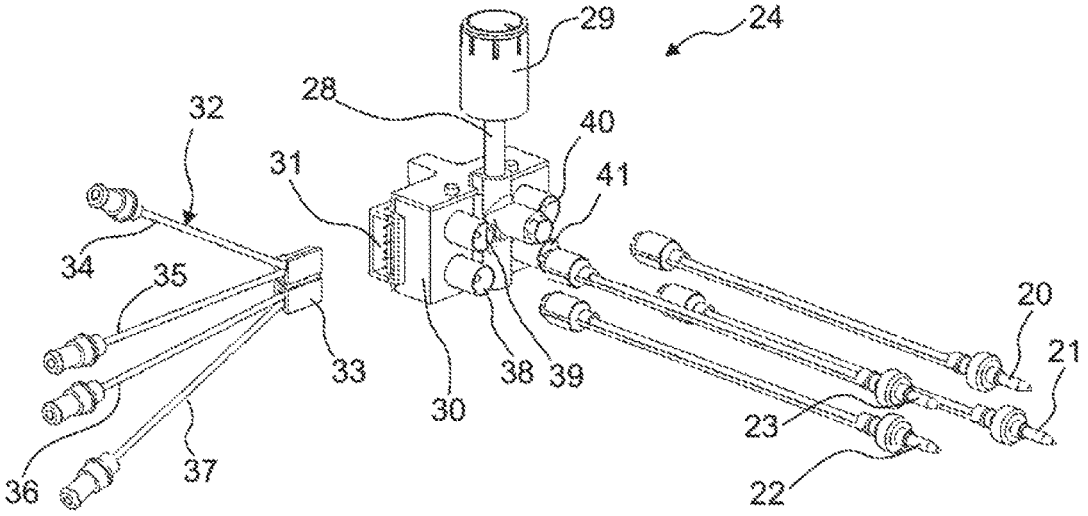
FIG. 2 shows a schematic perspective view of an embodiment of a switching device of a gas burner arrangement of the hotplate according to FIG. 2.

Each gas burner 4 to 8 is fluidically connected with the aid of a feed line 15 to 19 to the gas valve 9 to 13 assigned thereto. A thermoelement 20 to 23 is also assigned to each gas burner 4 to 8 (FIG. 2). FIG. 2 shows a switching device 24 with four thermoelements 20 to 23. The gas burner arrangement 3 may have the switching device 24. The switching device 24 is not shown in FIG. 1. The switching device 24 is suitable for a gas burner arrangement 3 with four gas burners 4 to 8. The switching device 24 can alternatively have five or six thermoelements 20 to 23. The number of thermoelements 20 to 23 preferably corresponds to the number of gas burners 4 to 8.

Each thermoelement 20 to 23 is arranged adjacent to a gas burner 4 to 8 which is assigned thereto. In FIG. 2 the thermoelements 20 to 23 are shown in an unassembled state. In other words, in FIG. 2 the thermoelements 20 to 23 are not yet arranged adjacent to the gas burner 4 to 8 assigned thereto. For instance, the thermoelements 20 to 23 can each be clamped to a burner base or burner housing of the corresponding gas burner 4 to 8 or otherwise fixedly connected thereto.

Each thermoelement 20 to 23 is configured to monitor a flame 25 (FIG. 3) of the gas burner 4 to 8 assigned to the respective thermoelement 20 to 23.

Figure 3:
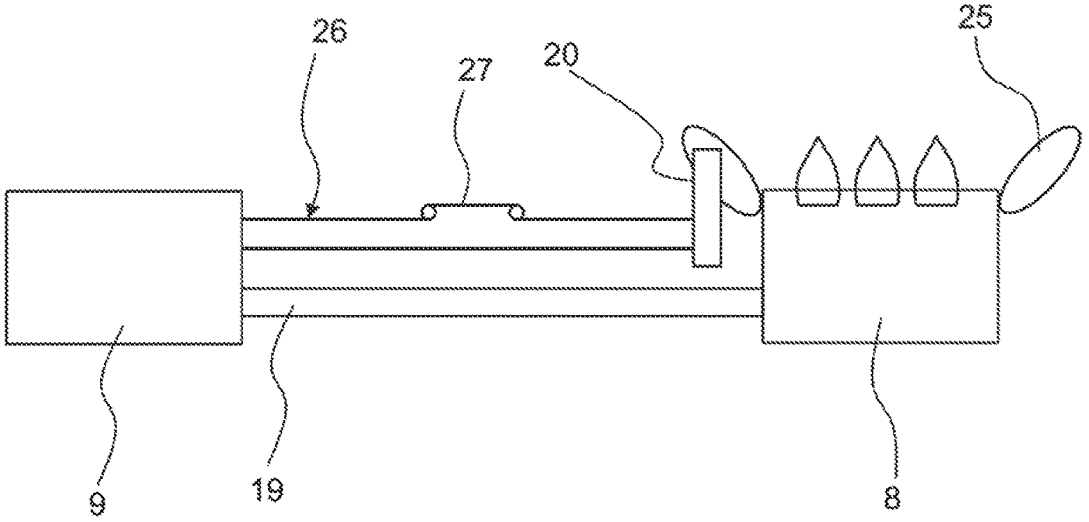
FIG. 3 shows a schematic side view of an embodiment of a gas burner arrangement of the hotplate according to FIG. 1.

As FIG. 3 shows, each thermoelement 20 to 23 is coupled to a gas valve 9 to 13 assigned thereto with the aid of an electrical circuit 26 such that when the flame 25 of the gas burner 4 to 8 is extinguished, the combustion gas flow to the gas burner 4 to 8 is automatically interrupted with the aid of the gas valve 9 to 13. In particular, when the flame 25 is present on the gas burner 4 to 8, the thermoelement 20 to 23 generates an electrical voltage, with the aid of which the gas valve 9 to 13 is held in an opened state. To this end, the gas valve 9 to 13 can comprise a solenoid valve. As soon as the flame 25 of the gas burner 4 to 8 is extinguished, an electromagnet of the solenoid valve is no longer applied with voltage and the gas valve 9 to 13 interrupts the combustion gas flow to the gas burner 4 to 8. Each electrical circuit 26 has a mechanically actuatable switch 27. The mechanically actuatable switches 27 are closed in an initial state or default state.

Each thermoelement 20 to 23 is also configured to transmit a continuous signal to the gas valve 9 to 13 assigned thereto when the flame 25 of the gas burner 4 to 8 is detected. The thermoelement 20 to 23 is also configured to interrupt the continuous signal when the flame 25 of the gas burner 4 to 8 is extinguished, so that the gas valve 9 to 13 interrupts the combustion gas flow to the gas burner 4 to 8. For this purpose each mechanically actuatable switch 27 of each electrical circuit 26 is configured to interrupt the continuous signal of the thermoelement 20 to 23 so that the gas valve 9 to 13 interrupts the combustion gas flow to the gas burner 4 to 8.

FIG. 2 shows the switching device 24, which has the mechanically actuatable switches 27 and an actuation element 28. The switching device 24 can be understood to be a master switch for a gas cooker. Reference is also made to a main switch, because, with the aid of the actuation knob and actuation element described below, operation of the gas burners or the function of the gas cooker can be interrupted or initiated. The actuation element 28 is preferably rod-shaped and may have a circular cross-section. An actuation knob 29 fastened in a torsion-proof manner is preferably provided on the actuation element 28. The switching device 24 has a housing 30 with a socket 31. A cable harness 32 with a plug-in element 33 can be inserted into the socket 31. The cable harness 32 has a number of connecting conductors 34 to 37 for connecting the switching device 24 to the gas valves 9 to 13. Moreover, sockets 38 to 41 for inserting the thermoelements 20 to 23 are provided on the housing. The sockets 38 to 41 can be arranged adjacent to one another and/or one above another.

Figure 4:
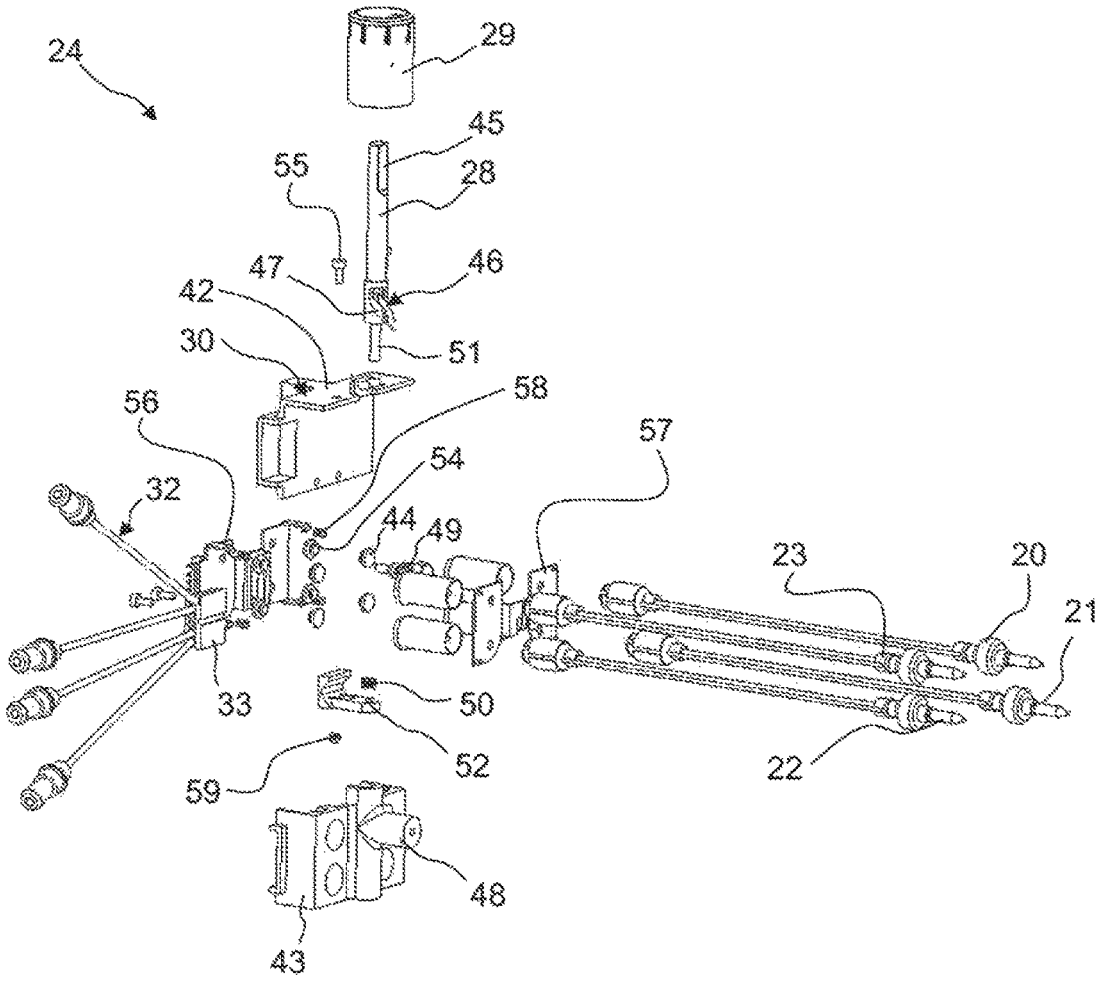
FIG. 4 shows a schematic perspective exploded view of the switching device according to FIG. 2.

FIG. 4 shows the switching device 24 in a schematic perspective exploded view. The housing 30 of the switching device 24 has a housing rear part 42 and a housing front part 43. The housing rear part 42 can be screwed with the aid of a screw 55 to the housing front part 43. The mechanically actuatable switches 27 each comprise contact elements 44, 54, which have a noble metal. A first support 56 which supports the contact elements 54 is accommodated in the housing 30. Furthermore, a second support 57 which supports the contact elements 44 is accommodated in the housing 30. The supports 56, 57 can be moved relative to one another. In particular, the supports 56, 57 for closing or opening the switches 27 can be moved toward or away from one another.

Figure 5:
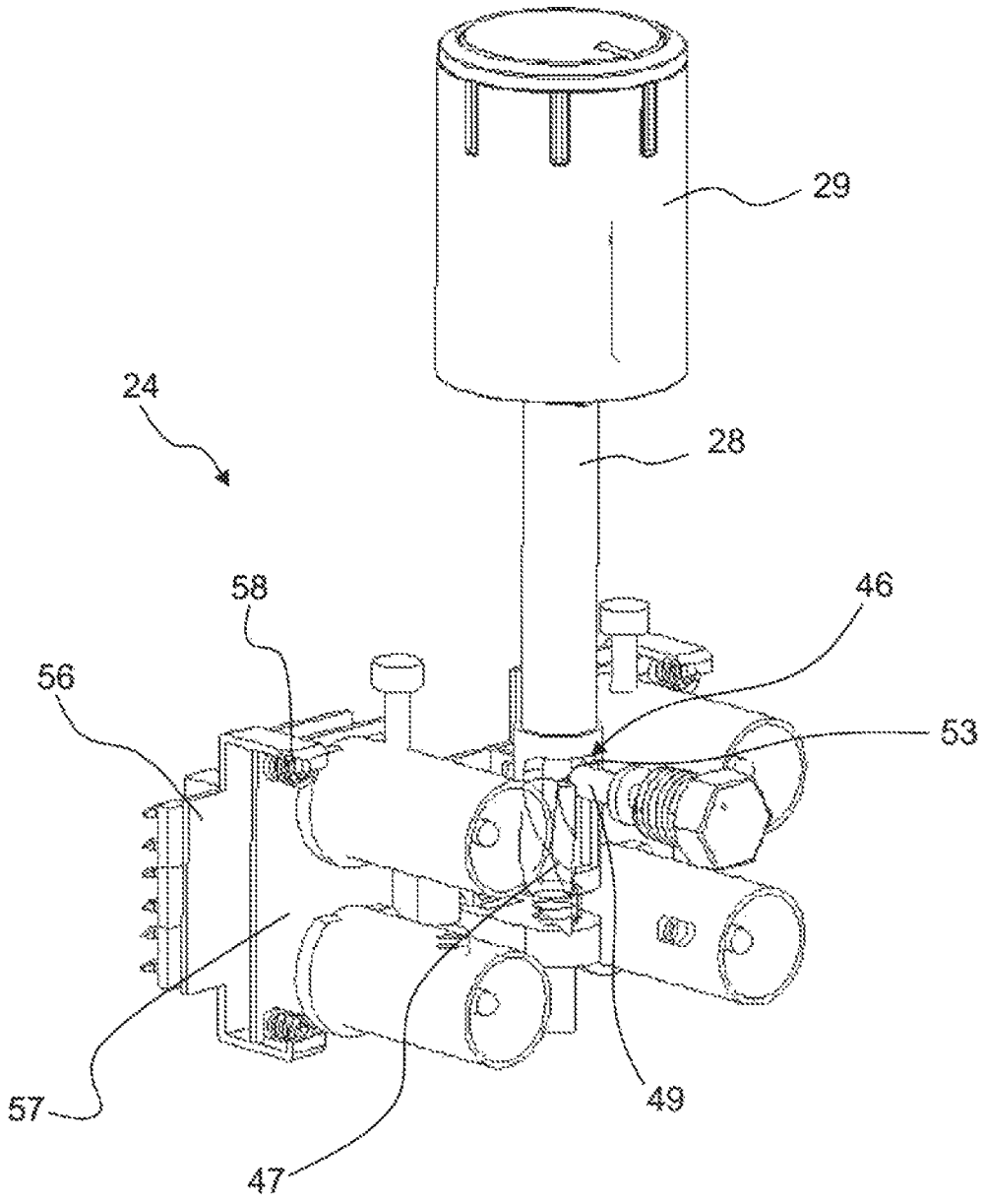
FIG. 5 shows an enlarged schematic perspective view of the switching device according to FIG. 2.

As FIG. 5 shows, the second support 57 is spring-pretensioned in the direction of the first support 56 with the aid of a number of spring devices 58. The spring devices 58 are preferably compression springs. In particular, four spring devices 58 are provided. At least one contact element 44, 54 is preferably assigned to each mechanically actuatable switch 27. As FIG. 4 shows, two contact elements 44, 54 can be assigned to each mechanically actuatable switch 27. The contact elements 44, 54 may have gold, silver, platinum or similar noble metals for instance. The mechanically actuatable switches 27 can be arranged adjacent to one another and/or one above another.

The switching device 24 according to FIG. 3 to FIG. 5 has four electrical circuits 26. The mechanically actuatable switches 27 of the electrical circuits 26 can be controlled with the aid of the shared actuation element 28 in order to interrupt the electrical circuits 26 between the thermoelements 20 to 23 and the gas valves 4 to 8. The actuation element 28 preferably has a flat area 45 on an end section, into which an engagement section of the actuation knob 29 engages in a form-fit manner A sliding block guide 46 with a guiding groove 47 is provided on a second end section of the actuation element 28. A spring-pretensioned guiding pin 49 screwed onto a cylindrical receiving section 48 of the front part 43 of the housing 30 extends into the guiding groove 47.

The actuation element 28 is pretensioned in the direction of a closed position of the mechanically actuatable switches 27 with the aid of a spring device 50. The spring device 50 is preferably a compression spring. The spring device 50 is in particular mounted onto a receiving section 51 of the actuation element 28. The spring device 50 is accommodated between the actuation element 28 and a supporting section 52. The supporting section 52 is coupled to the second support 57 such that when the actuation element 28 is pressed downwards against a spring force of the spring device 50, the mechanically actuatable switches 27 are opened. A further spring device 59 is arranged between the front part 43 of the housing 30 and the supporting section 52.

The mechanically actuatable switches 27 can thus be brought from the closed position into an open position by displacing the actuation element 28 against the spring force of the spring device 50. The sliding block guide 46 has a locking section 53, in which the guiding pin 49 engages in the open position (FIG. 5). The guiding pin 49 can be automatically displaced from the open position into the closed position by displacing the actuation element 28 in the direction of the open position and by simultaneously rotating the same with the aid of the spring device 50. In FIG. 5 the switching device 24 is shown in the open position. In the open position, the spring-pretensioned guiding pin 49 engages into the locking section 53.

Figure 6:
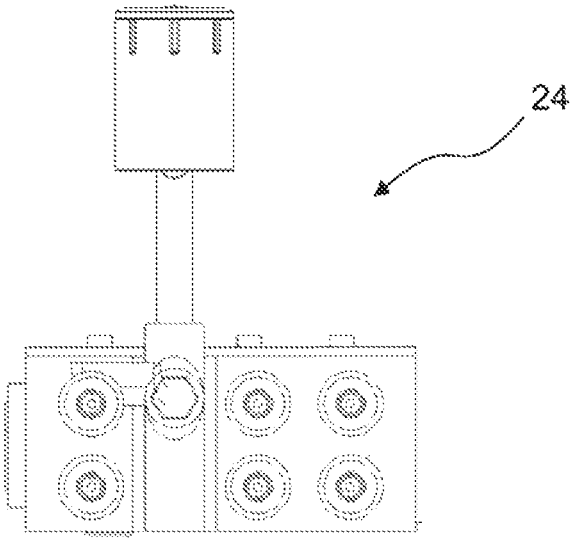
FIG. 6 shows a side view of a further embodiment of the switching device according to FIG. 2.

FIG. 6 shows an embodiment of a switching device 24 which is suitable for a gas burner arrangement 3 with six gas burners.

Figure 7:
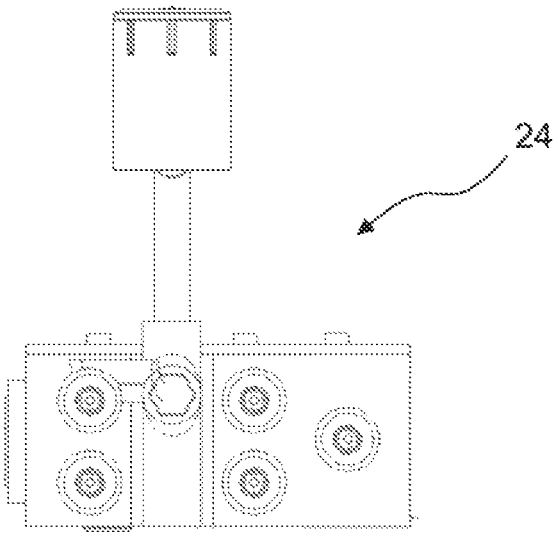
FIG. 7 shows a schematic view of a further embodiment of the switching device according to FIG. 2.

FIG. 7 shows an embodiment of a switching device 24 which is suitable for a gas burner arrangement 3 with five gas burners.

Figure 8:
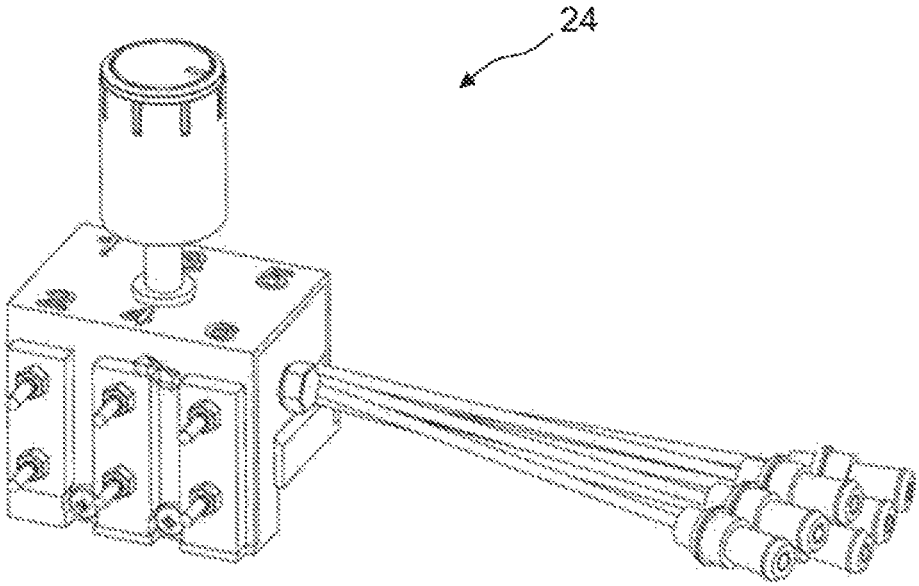
FIG. 8 shows a schematic perspective view of the switching device according to FIG. 6.

FIG. 8 shows the switching device 24 according to FIG. 6 in a schematic perspective view.

Figure 9:
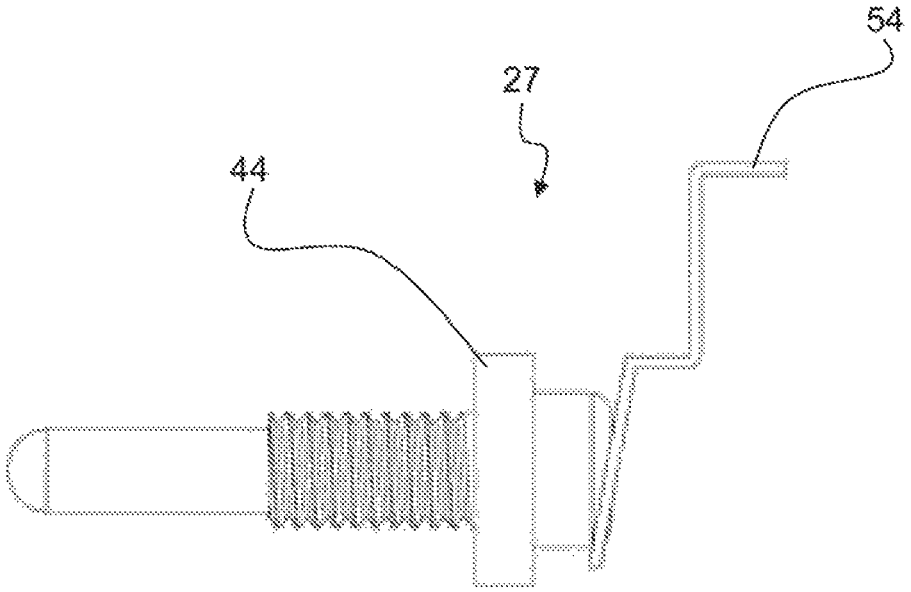
FIG. 9 shows a schematic side view of an embodiment of a mechanically actuatable switch.

FIG. 9 shows an embodiment of the mechanically actuatable switch 27 with the contact elements 44, 54. In this embodiment of the switch 27, the contact element 44 is bolt- or pin-shaped and the contact element 54 is plate- or sheet-shaped. The contact element 54 can be embodied as a spring.

Figure 10:
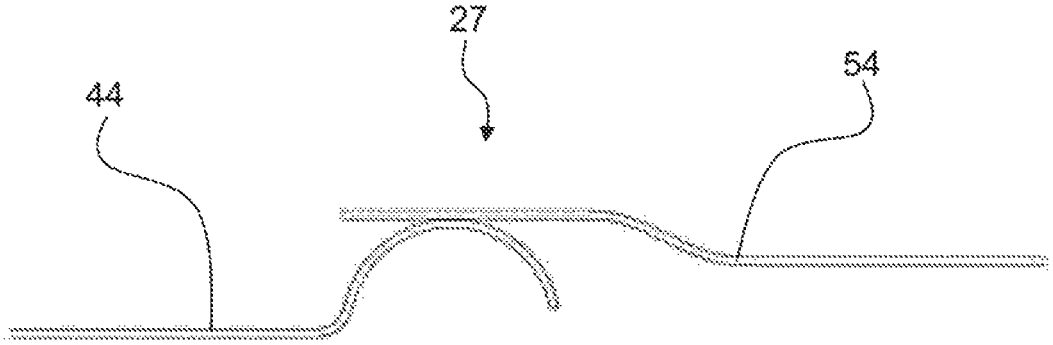
FIG. 10 shows a schematic side view of a further embodiment of a mechanically actuatable switch.

FIG. 10 shows a further embodiment of the mechanically actuatable switch 27 with the contact elements 44, 54. In this embodiment, both contact elements 44, 54 are sheet-shaped. The contact element 54 is offset. The contact element 44 has an arched contact section, against which the contact element 54 rests. Both contact elements 44, 54 can preferably be deformed in spring-elastic manner.

Figure 11:
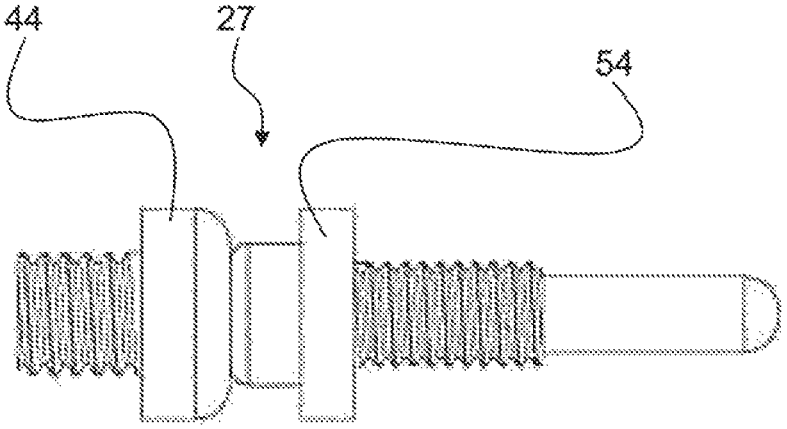
FIG. 11 shows a schematic side view of a further embodiment of a mechanically actuatable switch.

FIG. 11 shows a further embodiment of the mechanically actuatable switch 27 with the contact elements 44, 54. In this embodiment, both contact elements 44, 54 are bolt- or pin-shaped. In the closed position the contact elements 44, 54 abut one another at their end faces.

The invention claimed is:

1. A gas burner arrangement for a hotplate, comprising:

at least two gas burners, gas valves, operably connected to the gas burners in one-to-one correspondence, each of the gas valves configured to regulate for regulating a combustion gas flow to a corresponding one of the gas burners;

thermoelements, operably connected to the gas burners in one-to-one correspondence, each of the thermoelements configured to monitor a flame of a corresponding one of the gas burners;

electrical circuits, each electrical circuit coupling a corresponding one of the thermoelements with a corresponding one of the gas valves such that when the flame of a corresponding one of the gas burners is extinguished, the combustion gas flow to the corresponding gas burner is interrupted with the aid of the gas valve, each electrical circuit including a mechanically actuatable switch configured to couple or decouple the electrical circuit between the thermoelement and the gas valve;

a shared actuation element configured to control the mechanically actuatable switches of the electrical circuits, wherein the shared actuation element and the mechanically actuatable switches are components of a switching device; and a spring device configured to pretension the actuation element in a direction of a closed position of the mechanically actuatable switches;

wherein the mechanically actuatable switches are movable from the closed position into an open position by displacing the actuation element against a spring force of the spring device; and wherein the switching device includes a housing and a guiding pin provided on the housing, the actuation element including a sliding block guide having a locking section into which the guiding pin engages in the open position.

2. The gas burner arrangement of claim 1, wherein the guiding pin is configured to automatically move from the open position into the closed position by displacing the actuation element in a direction of the open position and by simultaneously rotating the actuation element with the aid of the spring device.

3. The gas burner arrangement of claim 1, wherein each mechanically actuatable switch further comprises a contact element including a noble metal.

4. The gas burner arrangement of claim 3, wherein the contact element includes gold.

5. A hotplate, comprising:

a gas burner arrangement comprising:

at least two gas burners;

gas valves, operably connected to the gas burners in one-to-one correspondence, each of the gas valves configured to regulate a combustion gas flow to a corresponding one of the gas burners;

thermoelements, operably connected to the gas burners in one-to-one correspondence, each of the thermoelements configured to monitor a flame of a corresponding one of the gas burners;

electrical circuits, each electrical circuit coupling a corresponding one of the thermoelements with a corresponding one of the gas valves such that when the flame of a corresponding one of the gas burners is extinguished, the combustion gas flow to the gas burner is interrupted with the aid of the gas valve, each electrical circuit including a mechanically actuatable switch configured to couple or decouple the electrical circuit between the thermoelement and the gas valve;

a shared actuation element including a sliding block guide having a locking section and configured to control the mechanically actuatable switches of the electric circuits; and a spring device configured to pretension the actuation element in a direction of a closed position of the mechanically actuatable switches;

wherein the mechanically actuatable switches are movable from the closed position into an open position by displacing the actuation element against a spring force of the spring device; and wherein the mechanically actuatable switches and the shared actuation element are components of a switching device having a housing and a guiding pin provided on the housing, the guiding pin configured to engage the locking section of the sliding block guide in the open position.

6. The hotplate of claim 5, wherein the guiding pin is configured to automatically move from the open position into the closed position by displacing the actuation element in a direction of the open position and by simultaneously rotating the actuation element with the aid of the spring device.

7. The hotplate of claim 5, wherein each mechanically actuatable switch further comprises a contact element including a noble metal.

8. The hotplate of claim 7, wherein the contact element includes gold.

9. A cooker, comprising at least one member selected from the group consisting of:

(a) a gas burner arrangement including:

at least two gas burners;

gas valves, operably connected to the gas burners in one-to-one correspondence, configured to regulate a combustion gas flow to the gas burners;

thermoelements, operably connected to the gas burners in one-to-one correspondence, configured to monitor a flame of the gas burners; electrical circuits, each electrical circuit coupling a corresponding one of the thermoelements with a corresponding one of the gas valves such that when the flame of a corresponding one of the gas burners is extinguished, the combustion gas flow to the gas burner is interrupted with the aid of the gas valve, each electrical circuit including a mechanically actuatable switch configured to couple or decouple the electrical circuit between the thermoelement and the gas valve, and a shared actuation element having a sliding block guide having a locking section and configured to control the mechanically actuatable switches of the electric circuits; and a spring device configured to pretension the actuation element in a direction of a closed position of the mechanically actuatable switches;

wherein the mechanically actuatable switches are movable from the closed position into an open position by displacing the actuation element against a spring force of the spring device;

wherein the mechanically actuatable switches and the shared actuation element are components of a switching device having a housing and a guiding pin provided on the housing, the guiding pin configured to engage within the locking section of the sliding block guide in the open position; and (b) a hotplate comprising said gas burner arrangement.

10. The cooker of claim 9, wherein each mechanically actuatable switch further comprises a contact element including a noble metal.

11. The cooker of claim 10, wherein the contact element includes gold.

12. The hotplate of claim 9, wherein the guiding pin is configured to automatically move from the open position into the closed position by displacing the actuation element in a direction of the open position and by simultaneously rotating the actuation element with the aid of the spring device.

* * * * *